United States Patent [19]

Booth et al.

[11] Patent Number: 4,461,803

[45] Date of Patent: Jul. 24, 1984

[54] PAPERMAKER'S FELT HAVING MULTI-LAYERED BASE FABRIC

[75] Inventors: Ian K. Booth, Clinton; Frank J. Cunnane, III, Laurens, both of S.C.

[73] Assignee: Ascoe Felts, Inc., Clinton, S.C.

[21] Appl. No.: 505,386

[22] Filed: Jun. 17, 1983

Related U.S. Application Data

[63] Continuation-in-part of Ser. No. 484,575, Apr. 13, 1983.

[51] Int. Cl.[3] ..... B32B 5/02

[52] U.S. Cl. ..... 428/234; 34/243 R; 139/383 A; 162/DIG. 1; 162/358; 428/257; 428/300

[58] Field of Search ..... 428/234, 257, 300; 162/DIG. 1, 358; 139/383 A; 34/243 F; 28/107

[56] References Cited

U.S. PATENT DOCUMENTS

| | | | |
|---|---|---|---|
| 1,801,081 | 4/1931 | Hindle | 139/383 A |
| 1,812,148 | 6/1931 | Hindle | 139/383 A |
| 1,834,343 | 12/1931 | Hindle | 139/383 A |
| 2,110,388 | 3/1938 | Asten | 139/383 |
| 2,180,054 | 11/1939 | Hindle et al. | 139/383 A |
| 2,540,874 | 2/1951 | Geddings | 139/383 |
| 2,797,713 | 7/1957 | Hoffacker | 139/411 |
| 2,947,328 | 8/1960 | Asten et al. | 139/412 |
| 2,949,134 | 8/1960 | Hindle et al. | 139/426 |
| 3,214,326 | 10/1965 | Lee | 162/205 |
| 3,885,603 | 5/1975 | Slaughter | 139/425 |
| 4,086,941 | 5/1978 | Thompson | 139/387 |
| 4,119,753 | 10/1978 | Smart | 428/234 |
| 4,141,388 | 2/1979 | Romanski et al. | 139/383 |
| 4,182,381 | 1/1980 | Gisbourne | 139/383 |
| 4,224,372 | 9/1980 | Romanski | 428/257 |
| 4,283,454 | 8/1981 | Buchanan | 428/233 |
| 4,290,209 | 9/1981 | Buchanan et al. | 34/123 |
| 4,351,874 | 9/1982 | Kirby | 428/229 |
| 4,356,225 | 10/1982 | Dufour | 428/234 |

*Primary Examiner*—James J. Bell

*Attorney, Agent, or Firm*—Benasutti and Murray

[57] ABSTRACT

A papermaker's wet felt having a multi-layered base fabric. Multiple layers of machine direction yarns are interwoven with a system of cross machine direction yarns having selected floats such that the cross machine yarns predominate both the top and bottom surfaces of the base fabric. Each yarn of the cross machine direction yarn system interweaving with at least two layers of machine direction yarns.

27 Claims, 4 Drawing Figures

FIG. 1
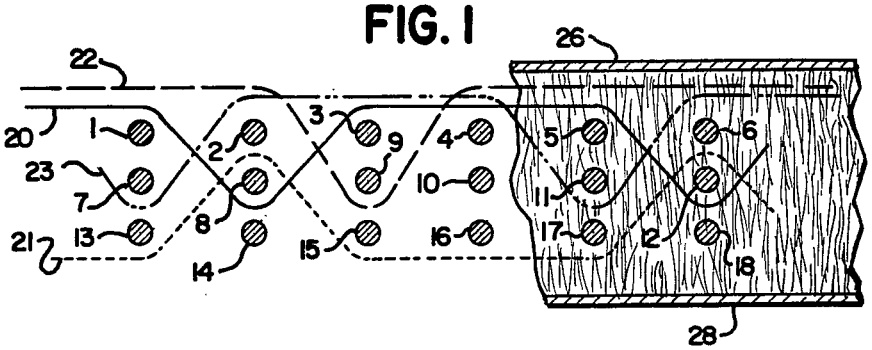
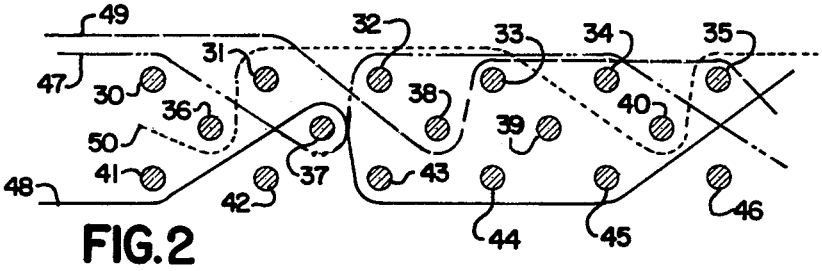
FIG. 2
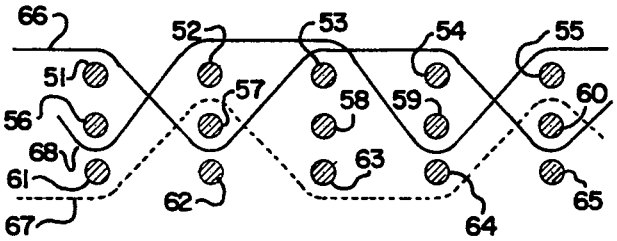
FIG. 3
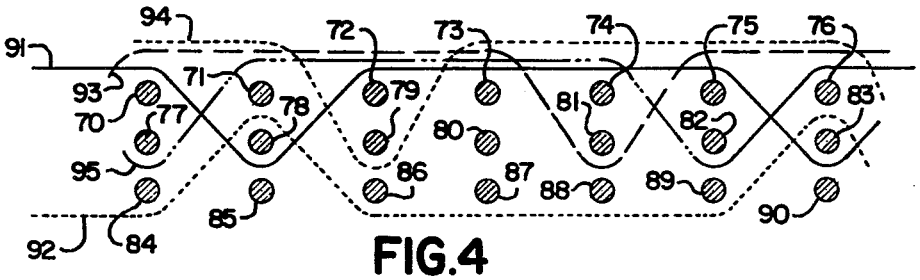
FIG. 4

PAPERMAKER'S FELT HAVING MULTI-LAYERED BASE FABRIC

This application is a continuation-in-part of our pending U.S. patent application Ser. No. 484,575, filed Apr. 13, 1983 entitled PAPERMAKERS SUPERIMPOSED FELT.

BACKGROUND OF THE INVENTION

This invention relates to papermaker's fabrics and in particular to fabrics used on the wet press section of a papermaking machine.

Papermaker's wet felts are designed to transport an aqueous web of paper through the press rollers of a papermaking machine and to assist in the de-watering thereof. In one form, a papermaker's wet felt is constructed from a woven base fabric having batts needled to one or both sides.

The amount of void volume within the base fabric of a wet felt is directly related to the amount of water which can be handled internally to the felt while in the nip. In other words, felts which can run with a "dry nip" (no water puddling behind the nip) are less likely to result in crushing or other hydraulic phenomena. It has been recognized in the art that it is possible to maintain a desired controlled void volume within the fabric construction by employing multi-layered base fabrics. One example of such a felt is disclosed in U.S. Pat. No. 4,356,225 which is assigned the assignee of the present invention. Other examples are also cited in that patent.

The surfaces of the base fabric of such conventional fabrics are predominantly defined by the top and bottom layers of machine direction yarns. The cross machine direction yarns which interweave the multiple layers of machine direction yarns of such fabrics protrude beyond the surfaces of the base fabric with sharp infrequent knuckles. It has been discovered that under the intense pressure of the nip, water removal can be impaired by the extremes of high and low pressure caused by the cross-machine direction yarn knuckles on the paperbearing side of the fabric. Also, on the other side of the fabric, the knuckles represent high pressure points which result in accelerated wear of the fabric.

SUMMARY AND OBJECT OF THE INVENTION

The present invention provides a papermaker's wet felt for use in the wet press section of a papermaker's machine. The disclosed papermaker's felt comprises a multi-layered base fabric having cross-machine yarns which interweave with the multiple layers of machine direction yarns such that the cross-machine direction yarns predominantly define the top and bottom surfaces of the base fabric. The cross-machine direction yarns are woven in a repeat pattern having floats which extend above the top layer of machine direction yarns and below the bottom layer of machine direction yarns so as to define the predominance of cross-machine direction yarns on the surfaces of the base fabric.

It is an object of the present invention to provide a papermaker's wet felt comprising a multi-layered base fabric having both a smooth pressing surface and a roll side surface resistant to wear.

In particular, it is an object of the invention to provide a system of cross-machine direction yarns which interweave multiple layers of machine direction yarns without creating sharp knuckles on either surface of the base fabric of the wet felt.

Other objects and advantages of the present invention will become apparent from the following portion of the specification and from the accompanying drawings which illustrate, in accordance with the mandate of the Patent Statutes, a presently preferred embodiment incorporating the principles of the invention.

BRIEF DESCRIPTION OF THE DRAWINGS

FIG. 1 is a schematic diagram of a papermaker's wet felt according to the teachings of the present invention;

FIG. 2 is a schematic diagram of the weave of an alternate embodiment of a base fabric according to the teachings of the present invention;

FIG. 3 is a schematic diagram of the weave of a second alternate embodiment for the base fabric;

FIG. 4 is a schematic diagram of the weave of a third alternate embodiment for the base fabric.

DETAILED DESCRIPTION OF THE INVENTION

Referring to FIG. 1, there is illustrated a papermaker's wet felt comprised of a three-ply base fabric (yarns 1–23) and a pair of batts 26, 28 (only partially shown) needled to the top and bottom of the base fabric.

The base fabric is comprised of three-plies or layers of machine direction yarns and a system of cross-machine direction (or CMD) yarns interwoven with the machine direction layers in a repeat pattern of 8 yarns. The top layer of the fabric is defined by machine direction yarns 1–6; the middle layer by yarns 7–12; and the bottom layer by yarns 13–18. These layers 1–6, 7–12, 13–18 of machine direction yarns are maintained vertically aligned as they are interwoven by the CMD yarn system.

The CMD yarn system is interwoven in a repeat of eight yarns such that the CMD yarns predominate and thereby define the surfaces of the base fabric. For clarity only the first, second, third and fifth yarns 20, 21, 22, 23 respectively, of the eight yarn repeat are illustrated in FIG. 1. However, the interweavings of all eight CMD yarns of the repeat are described below to enable those skilled in the art to weave the instant fabric.

The first CMD yarn 20 of the repeat weaves over yarn 1 of the top layer drops below yarn 8 of the middle layer, above the top layer in a float across yarns 3, 4 and 5, and drops below yarn 12 of the middle layer before it again rises above the top layer in a float extending for three machine direction yarns.

The second CMD yarn weaves below bottom layer yarn 13, rises above middle layer yarn 8, drops below the bottom layer in a float below yarns 15, 16 and 17, and rises above yarn 12 of the middle layer from where it again drops below the bottom layer of machine direction yarns in a float extending for three yarns.

The third CMD yarn 22 of the repeat weaves above top layer yarns 1 and 2, drops below middle layer yarn 9, and rises above the top layer in a float extending across yarns 4, 5 and 6 from where it again drops below the middle layer to interweave with one yarn thereof.

The fourth CMD yarn (not shown) of the repeat weaves below bottom layer yarns 13 and 14, rises above middle layer yarn 9, and drops below the bottom layer in a float extending across yarns 16, 17 and 18 from where it again rises above the middle layer to interweave with one yarn thereof.

The fifth CMD yarn 23 of the repeat weaves below middle layer yarn 7, rises above top layer yarns 2, 3 and 4, drops below middle layer yarn 11, and rises above top layer yarn 6 in a float extending across three top layer yarns.

The sixth CMD yarn (not shown) of the repeat weaves above middle layer yarn 7, drops below the bottom layer in a float extending across yarns 14, 15 and 16, rises above middle layer yarn 11 and drops below bottom layer yarn 18 in a float below three bottom layer yarns.

The seventh CMD yarn (not shown) of the repeat weaves above top layer yarns 1, 2 and 3, drops below middle layer yarn 10, rises above top layer yarns 5 and 6 in a float extending across three top layer yarns.

The eighth CMD yarn (not shown) of the repeat weaves below bottom layer yarns 13, 14 and 15, rises above middle layer yarn 10, drops below bottom layer yarns 17 and 18 in a float extending below three bottom layer yarns.

As described above, each CMD yarn of the cross-machine direction yarn system interweaves with at least two layers of machine-direction yarns. The interweavings of each CMD yarn which weave with the top machine direction layer are comprised of floats extending above three top layer yarns. Likewise, the interweavings of each CMD yarn which weave with the bottom machine direction layer are comprised of floats extending below the bottom layer yarns. Accordingly, the yarns do not form infrequent knuckles in the surface of the base fabric; rather the CMD yarns predominate and define the smooth upper and lower surfaces of the base fabric.

In the preferred embodiment, the base fabric is woven almost exclusively of continuous mono-filament or multi-filament yarns. Also, a batt 26 is needled to the paper-bearing side of the base fabric to facilitate dewatering of the felt at suction boxes before re-entering the nip. In some applications, where roll side wear is especially acute, a fairly light second batt 28 is needled to the other side of the base fabric to help absorb abrasive wear.

Although batts are employed with conventional base fabrics, the problems created by the sharp infrequent CMD yarn knuckles inherent with those base fabrics exist when the fabric passes through the extreme high pressures found in the nip of a papermaking machine. The present invention eliminates the sharp infrequent knuckles of the CMD yarns on both sides of the base fabric. Both the top and bottom surfaces of the base fabric are defined with a predominance of CMD yarns which interweave the multiple layers of the base fabric. The batt-on-base fabric employing the disclosed base fabric, accordingly, has improved wear and non-marking characteristics over conventional fabrics.

Referring now to FIG. 2, there is shown an alternate embodiment of a base fabric made in accordance with the teachings of the invention. This base fabric is also comprised of three layers of machine direction yarns interwoven in the same manner with a cross-machine direction yarn system having a repeat of eight yarns. The top layer of machine-direction yarns is formed by yarns 30–35, the middle layer by yarns 36–40, and the bottom layer by yarns 41–46. However, the fabric is woven with fewer machine direction yarns per inch such that the interweavings of the CMD yarn system causes the middle layer of machine direction yarns to be offset and the void volume of the base fabric to be reduced accordingly.

For clarity only, the first, second, third, and fifth yarns of the cross-machine direction yarn system's repeat are illustrated in FIG. 2. However, the interweavings of each CMD yarn of the repeat pattern are described below.

The first yarn 47 of the CMD system repeat originates above top layer yarn 30, drops between yarns 31 and 36 to pass under yarn 37 of the middle layer, rises above the top layer in a float extending across yarns 32, 33 and 34, and drops between yarns 35 and 40 to again weave below one yarn of the middle layer.

The second CMD yarn 48 of the repeat originates below bottom layer yarn 41, rises between yarns 42 and 36 to pass above 37 of the middle layer, drops below the bottom layer in a float extending below yarns 43, 44 and 45, and rises between yarns 46 and 40 to again weave above one yarn of the middle layer.

The third CMD yarn 49 weaves above top layer yarns 30, 31, drops between yarns 32 and 37 to pass under yarn 38 of the middle layer, rises above the top layer in a float extending across yarns 33, 34 and 35, from where it again weaves below one yarn of the middle layer.

The fourth CMD yarn (not shown) of the repeat weaves with the bottom and middle layers of machine direction yarns such that it is symmetric with the third CMD yarn 49 (i.e. weaves about middle layer yarn 38.)

The fifth CMD yarn 50 of the repeat weaves under yarn 36 of the middle layer, rises above the top layer in a float extending across yarns 31, 32 and 33, and drops between yarns 34 and 39 to weave below yarn 40 of the middle layer from where it rises above top layer yarn 35 in a float extending over three top layer yarns.

The sixth CMD yarn (not shown) of the repeat weaves with the bottom and middle layers such that it is symmetric with the fifth CMD yarn 50 (i.e. weaving about middle layer yarns 36 and 40.)

The seventh CMD yarn (not shown) of the repeat floats over top layer yarns 30, 31 and 32, drops between yarns 33 and 38 to pass under yarn 39 of the middle layer, and rises above top layer yarn 34 in a float extending over three top layer yarns.

The eighth CMD yarn of the repeat weaves with the bottom and middle layers such that it is symmetric with the seventh yarn of the repeat (i.e. weaving about middle layer yarn 39).

Since the middle layer 32–40 of machine direction yarns is offset with respect to the top and bottom machine direction yarn layers, the interweaving of the cross-machine direction yarns produce a base fabric which is somewhat thinner than the "stacked" configuration depicted in FIG. 1. Accordingly, this base fabric (FIG. 2) may be employed when a lower void volume is desired. However, the cross-machine direction yarns predominate the surfaces of both embodiments of the base fabric.

A second alternate embodiment of the base fabric is shown in FIG. 3. This fabric is comprised of three layers of machine direction yarns which are interwoven by a cross-machine direction yarn system having a repeat of six CMD yarns. The top layer of the base fabric is formed by machine direction yarns 51–55, the middle layer by yarns 56–60, and the bottom layer by yarns 61 through 65. These 3 layers are vertically aligned during weaving and are maintained in their stacked relationship by the CMD yarn system.

For clarity only, the first, second and third yarns 66, 67, 68 of the six yarn CMD system repeat are shown in FIG. 3. However, the interweavings of each of the six yarns of the repeat are described in detail below.

The first CMD yarn 66 of the six yarn repeat originates above top layer yarn 51, drops below middle layer yarn 57, rises above the top layer in a float over yarns 53 and 54, and drops below middle layer yarn 60 from where it again rises above the top layer in a float over two top layer yarns.

The second CMD yarn 67 of the repeat originates below bottom layer yarn 61, rises above middle layer yarn 57, drops below the bottom layer in a float under yarns 63 and 64, and rises above middle layer yarn 60 from where it again drops below the bottom layer in a float under two bottom layer yarns.

The third CMD yarn 68 of the repeat weaves below middle layer yarn 56, rises above the top layer in a float over yarns 52 and 53, and drops below middle layer yarn 59 from where it rises above the top layer in a float over two top layer yarns.

The fourth CMD yarn (not shown) of the repeat weaves with the bottom and middle layers such that it is symmetric with the third yarn 68 of the repeat (i.e. weaving about middle layer yarns 56 and 59.)

The fifth CMD yarn (not shown) of the repeat floats over top layer yarns 51 and 52, drops below middle layer yarn 58, and rises above the top layer in a float over yarns 54 and 55.

The sixth CMD yarn (not shown) of the repeat weaves with the bottom and middle layers such that it is symmetric with the fifth yarn of the repeat (i.e. weaving about middle layer yarn 58.)

This base fabric also is characterized by a predominance of CMD yarns on both its top and bottom surfaces. This predominance is attributable to the floats of the CMD yarns which extend over the top layer 51–55 of machine direction yarns and under the bottom layer 61–65 of machine direction yarns. In this embodiment, the predominance of CMD yarns in the surfaces of the base fabric is somewhat less than the predominance of CMD yarns in the base fabric depicted in FIG. 1.

Referring now to FIG. 4, a third alternate embodiment of the base fabric is illustrated. This base fabric is comprised of three layers of machine direction yarns which are interwoven with a cross-machine direction yarn system having a repeat of ten CMD yarns. The top layer is formed by machine direction yarns 70–76, the middle layer through yarns 77–83, and the bottom layer by yarns 84–90. The three layers are vertically aligned during weaving and the cross-machine direction yarn system maintains their vertical alignment in the woven base fabric.

For clarity, only the first, second, third, fifth and seventh yarns of the 10 yarn cross-machine system repeat are illustrated in FIG. 4. However, each yarn of the repeat is described in detail below.

The first CMD yarn 91 of the ten yarn repeat originates above top layer yarn 70, drops below middle layer yarn 78, rises above the top layer in a float over yarns 72, 73, 74 and 75, and drops below middle layer yarn 83 from where it again rises above the top layer in a float over four top layer yarns.

The second CMD yarn 92 of the repeat weaves with bottom and middle layers such that it is symmetric with the first yarn of the repeat (i.e. weaving about middle layer yarns 78 and 83).

The third CMD yarn 93 of the repeat floats over top layer yarns 70, 71, 72 and 73, drops below middle layer yarn 81 and rises above the top layer in a float over four top layer yarns.

The fourth CMD yarn (not shown) of the repeat weaves with the bottom and middle layers such that is symmetric with the third of the repeat (i.e. weaves about middle layer yarn 81).

The fifth CMD yarn 94 of the repeat weaves above top layer yarns 70 and 71, drops below middle layer yarn 79, and rises above the top layer in a float over yarns 73, 74, 75 and 76, from where it again drops below the middle layer to interweave with one yarn thereof.

The sixth CMD yarn (not shown) of the repeat weaves with the bottom and middle layers such that is symmetric with the fifth yarn of the repeat (i.e. weaves about middle layer yarn 79).

The seventh CMD yarn 95 of the repeat weaves below middle layer yarn 77, rises above the top layer in a float over yarns 71, 72, 73 and 74, and drops below middle layer yarn 82 from where it again rises above the top layer in a float over four top layer yarns.

The eight CMD yarns (not shown) of the repeat weaves with the bottom and middle layers such that it is symmetric with the seventh yarn of the repeat (i.e. weaves about middle layer yarns 77 and 82.)

The ninth CMD yarn (not shown) of the repeat floats over top layer yarns 70, 71 and 72, drops below middle layer yarn 80, and rises above the top layer in a float over four top layer yarns.

The tenth CMD yarn (not shown) of the repeat weaves with the bottom and middle layers such that it is symmetric with the ninth yarn of the repeat (i.e. weaves about middle layer yarn 80).

The respective top and bottom surfaces of this base fabric (FIG. 4) are predominated by the CMD yarns which extend over the top layer of machine direction yarns and those which extend under the bottom layer of machine direction yarns. Due to the length of the floats (4 yarns) in the weave, the predominance of the cross-machine direction yarns in the surfaces of this base fabric is greater than the predominance of cross-machine direction yarns in the surfaces of the base fabric illustrated in FIG. 1. Again, this base fabric (FIG. 4) provides the advantages associated with having both sides of the base fabric predominated by the CMD yarns as described above.

What we claim is:

1. A multi-layer papermaker's wet felt comprising:

a top layer of machine direction yarns;

at least one intermediate layer of machine direction yarns;

a bottom layer of machine direction yarns;

a system of cross-machine direction yarns for interwoven with said top, middle and bottom machine direction layers, each said cross-machine direction yarns woven in a repeat pattern having interlacings with machine direction yarns in at least two of said machine direction layers;

each said cross-machine direction yarns interwoven with said top layer with floats which extend over at least two top layer yarns so that said cross-machine direction yarns predominate the surface which they define with said top layer;

each said cross-machine direction yarns interweaving with said bottom layer with floats which extend under at least two machine direction yarns so that said cross-machine direction yarns predominate the surface which they define with said bottom layer.

2. A papermaker's wet felt according to claim 1 wherein said wet felt further comprises:

at least one batt needled thereto.

3. A papermaker's wet felt according to claim 1 wherein:

said floats extend for at least three machine direction yarns of said top and bottom layers respectively.

4. A papermaker's wet felt according to claim 3 wherein:

said repeat pattern repeats on eight cross-machine direction yarns.

5. A papermaker's wet felt according to claim 4 wherein said wet felt further comprises:

at least one batt needled thereto.

6. A papermaker's wet felt according to claim 4 wherein:

said layers of machine direction yarns are vertically aligned.

7. A papermaker's wet felt according to claim 6 wherein said wet felt further comprises:

at least one batt needled thereto.

8. A papermaker's wet felt according to claim 1 wherein:

said repeat pattern repeats on six cross-machine direction yarns.

9. A papermaker's wet felt according to claim 8 wherein:

said layers of machine direction yarns are vertically aligned.

10. A papermaker's wet felt according to claim 9 wherein said wet felt further comprises:

at least one batt needled thereto.

11. A papermaker's wet felt according to claim 1 wherein:

said floats extend for at least four machine direction yarns of said top and bottom layers, respectively.

12. A papermaker's wet felt according to claim 11 wherein:

said repeat pattern repeats on ten cross-machine direction direction yarns.

13. A papermaker's wet felt according to claim 12 wherein:

said layers of machine direction yarns are vertically aligned.

14. A papermaker's wet felt according to claim 13 wherein said wet felt futher comprises:

at least one batt needled thereto.

15. A papermaker's wet felt comprising:

a top layer of machine direction yarns;

a middle layer of machine direction yarns;

a bottom layer of machine direction yarns; and a system of cross-machine direction yarns selectively interwoven with said machine direction yarns for providing smooth surfaces above said top layer and below said bottom layer, including:

a first sub-system interwoven with said top and middle layers in a repeat pattern having floats extending over at least two top layer yarns; and a second sub-system interweaving with said bottom and middle layers in a repeat pattern having floats extending under at least two bottom layer yarns.

16. A papermaker's wet felt according to claim 15 further comprising:

a batt needled to at least one of said surfaces.

17. A papermaker's wet felt according to claim 15 wherein said cross-machine yarn system is interwoven with said machine direction yarn in a repeat of 8 yarns such that each of said sub-systems have a repeat of 4 yarns.

18. A papermaker's wet felt according to claim 17 wherein said floats of each said cross-machine sub-system extend for at least three machine direction yarns.

19. A papermaker's wet felt according to claim 18 wherein:

said layers of machine direction yarns are vertically aligned.

20. A papermaker's wet felt according to claim 19 further comprising:

a batt needled to at least one of said surfaces.

21. A papermaker's wet felt according to claim 15 wherein said cross-machine yarn system is interwoven with said machine direction yarn in a repeat of 6 yarns such that each of said sub-systems have a repeat of 3 yarns.

22. A papermaker's wet felt according to claim 21 wherein:

said layers of machine direction yarns are vertically aligned.

23. A papermaker's wet felt according to claim 22 further comprising:

a batt needled to at least one of said surfaces.

24. A papermaker's wet felt according to claim 15 wherein:

said cross-machine yarn system is interwoven with said machine direction yarn in a repeat of 10 yarns such that each of said sub-systems have a repeat of 5 yarns.

25. A papermaker's wet felt according to claim 24 wherein:

said floats of each said cross-machine sub-system extend for at least four machine direction yarns.

26. A papermaker's wet felt according to claim 25 wherein:

said layers of machine direction yarns are vertically aligned.

27. A papermaker's felt according to claim 26 further comprising:

a batt needled to at least one of said surfaces.

* * * * *